US006407500B1

(12) United States Patent
Tsuburaya et al.

(10) Patent No.: US 6,407,500 B1
(45) Date of Patent: Jun. 18, 2002

(54) ELECTRODE STRUCTURE IN FLAT VACUUM ENVELOPE

(75) Inventors: Kazuhiko Tsuburaya; Yoshitaka Kagawa, both of Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/379,571

(22) Filed: Aug. 24, 1999

(30) Foreign Application Priority Data

Aug. 26, 1998 (JP) ..... 10-240246

(51) Int. Cl.[7] ..... H01J 63/04

(52) U.S. Cl. ..... 313/495; 313/496; 313/318.12; 313/558

(58) Field of Search ..... 313/495, 496, 313/497, 493, 309, 310, 335, 422, 318.12, 42, 43, 51, 558, 623; 315/169.1

(56) References Cited

U.S. PATENT DOCUMENTS 5,965,978 A * 10/1999 Kishino et al. ..... 313/496
6,084,344 A * 7/2000 Kishino et al. ..... 313/495
6,114,804 A * 9/2000 Kawase et al. ..... 313/495

FOREIGN PATENT DOCUMENTS

JP 4-163833 * 6/1992 ..... H01J/31/12
JP 10-31433 * 2/1998 ..... G09F/9/30

* cited by examiner

*Primary Examiner*—Nimeshkumar D. Patel
*Assistant Examiner*—Karabi Guharay
(74) *Attorney, Agent, or Firm*—Oblon, Spivak, McClelland, Maier & Neustadt, P.C.

(57) ABSTRACT

A flat vacuum envelope is provided where an anode electrode is conductively connected to the contact portion of a high-voltage supplying lead with high reliability so that the connection electrode plate is not stripped from the anode electrode (*a*). A field emission region (1*a*), which is formed of a gate layer and emitters, is laminated on a first glass electrode (1). An anode electrode (2*a*), which is formed of a fluorescent display substance and a transparent electrode, is laminated on a second glass substrate (2). An exhaust tube (4) is formed to the first glass substrate (1) to evacuate the inside of the vacuum envelope. The lead (5) is connected to the anode electrode (2*a*) via the connection anode plate (6). The connection anode plate (6) is joined to the anode electrode (2*a*) by the resilient member (20) so that the conductivity thereof is not impaired while the exhaust tube (4) is being sealed.

7 Claims, 6 Drawing Sheets

1
1a
2
2a
3
4
4a
5
5a
5b
6
7
8
A
B

ELECTRODE STRUCTURE IN FLAT VACUUM ENVELOPE

BACKGROUND OF THE INVENTION

The present invention relates to a vacuum envelope effective to various devices where field emission elements, each emitting electrons in an electric field, are arranged within the vacuum envelope. Particularly, the present invention relates to an electrode leading structure in a vacuum envelope for photoelectric conversion elements or displays employing field emission devices (FEDs) being flat-emission-type cold cathode ray tubes fabricated by the semiconductor micro-processing technology.

The Spindt-type field emission cathodes (FECs) are now in the practical stage as field emission elements fabricated by fully using the semiconductor technology and are well employed for displays.

FIG. 7 schematically illustrates the configuration of a Spindt-type cathode field emission cathode. This perspective view shows a field emission cathode manufactured using the semiconductor micro-processing technology.

Referring to FIG. 7, a cathode k is vapor-deposited on the substrate S. Cone emitters E are formed on the surface of the cathode K. A gate GT is formed over the cathode K via the insulating layer of a silicon dioxide (SiO2). The cone emitters E are respectively formed within holes opened in the gate GT. The tips of the cone emitters E are respectively viewed from the openings of the gate GT.

The micro-processing technology is employed to fabricate the cone emitters E arranged with pitches of less than 10 microns. Field emission cathodes of several ten thousands to several hundred thousands can be formed on a single substrate S.

Since the space between the gate GT and a cone emitter E can be set to the order of sub-microns, the emitter E field-emits electrons with several ten volts Vgk applied between the gate GT and the cathode K.

The anode A is spaced from the gate GT by a predetermined distance. The anode A can attract electrons emitted from the emitter E with the anode voltage Va applied. A fluorescent substance (not shown) coated over the anode A is excited by the accelerated electrons so that the display becomes a glow state.

With the photoelectric conversion layer film stacked over the anode A, the anode current depends on the light amount externally applied. An image pickup can detect the anode current.

In the conventional field emission display shown in FIG. 7, the space between the gate GT and the anode A is the order of several hundred micrometers. Such a field emission device allows a very thin vacuum envelope to be fabricated.

FIG. 8 is a cross sectional view partially illustrating the main portion of the flat vacuum envelope.

Referring to FIG. 8, a first glass substrate 11 has a field emission portion 11*a* formed of emitters E and the gate GT. A second glass substrate 12 has an anode 12*a* which has a laminated layer of a fluorescent display substance and a transparent electrode acting as a conductive metal-back layer. A side wall portion 13 surrounds the space between the first glass substrate 11 and the second substrate 12 to maintain a vacuum state. Normally, the side wall portion 13 is constructed slightly larger to define a getter room. The end portions of the side wall portion are joined with the first glass substrate and the second glass substrate using the fritted glass 14 so that the inside thereof is maintained in a vacuum state.

Numeral 13*a* represents an exhaust hole attached to evacuate the vacuum envelope to a vacuum state. The exhaust tube 13*b* externally attached to the exhaust hole 13*a* is used to evacuate the inside the vacuum envelope. The vacuum envelope is fabricated by sealing the exhaust tube 13*a*.

The side wall section 13 has a hole 13*c* through which the lead 15 passes to be in contact with the anode 12*a*.

With the lead 15 penetrating the hole 13*c*, the side wall portion 13 is securely fixed with the crystallized glass 13*d* while the spring member 15*a* formed at the front end of the lead 15 is resiliently contacted to the anode 12*a*. Thus, a relatively high voltage can be applied to the anode 12*a*.

A relatively-low drive voltage applied to the field mission portion 11*a* on which the emitters E and the gate GT are formed can be externally applied via a great number of transparent conductive films printed on the first glass substrate 11 (not shown).

According to the flat vacuum envelope mentioned above, the lead 15 is in direct contact with the anode 12*a* and is drawn outside thereof, so that the contact between the anode 12*a* and the lead 15 becomes unstable. This causes a frequent contact failure or a self-discharge occurs when a high voltage of, for instance, several kilovolts is applied to the anode.

Particularly, the conductivity between the front end of the lead 15 and the anode 12*a* is achieved with the contact pressure of the spring member 15*a* of the front end after the sealing of the side wall portion 13. However, the conductivity may be impaired because of impact during fabrication or mechanical shock after fabrication. This results in poor manufacturing yields and poor product reliability.

SUMMARY OF THE INVENTION

The present invention is made to solve the above-mentioned problems.

Moreover, the objective of the invention is to provide a flat vacuum envelope where an anode electrode can be connected to the high-voltage supplying electrode with high reliability.

The objective of the present invention is achieved by an electrode structure within a flat vacuum envelope comprising a first glass substrate on which field emission cathodes are arranged on a surface thereof; a second glass substrate on which an anode electrode to attract electrons emitted from the field emission cathodes, the second glass substrate being confronted with the first glass substrate, a space between the first glass substrate and the second glass substrate being maintained in a vacuum state; a connection electrode plate placed on the anode electrode and acting as a conductive metal plate; and a lead connected to the connection electrode plate and externally extended through the first glass substrate or the vacuum envelope.

BRIEF DESCRIPTION OF THE DRAWINGS

This and other objects, features, and advantages of the present invention will become more apparent upon a reading of the following detailed description and drawings, in which:

FIGS. 4(*b*) and 4(*c*) are projection views, each illustrating a connection electrode plate and a lead used for the electrode structure of a flat vacuum envelope according to the present invention;

FIG. 5(*b*) is a perspective view, each illustrating the structure where a spring member is inserted between a lead and a connection electrode plate;

DETAILED DESCRIPTION OF THE PREFERED EMBODIMENTS

Figures 1A, 1B, 1C:
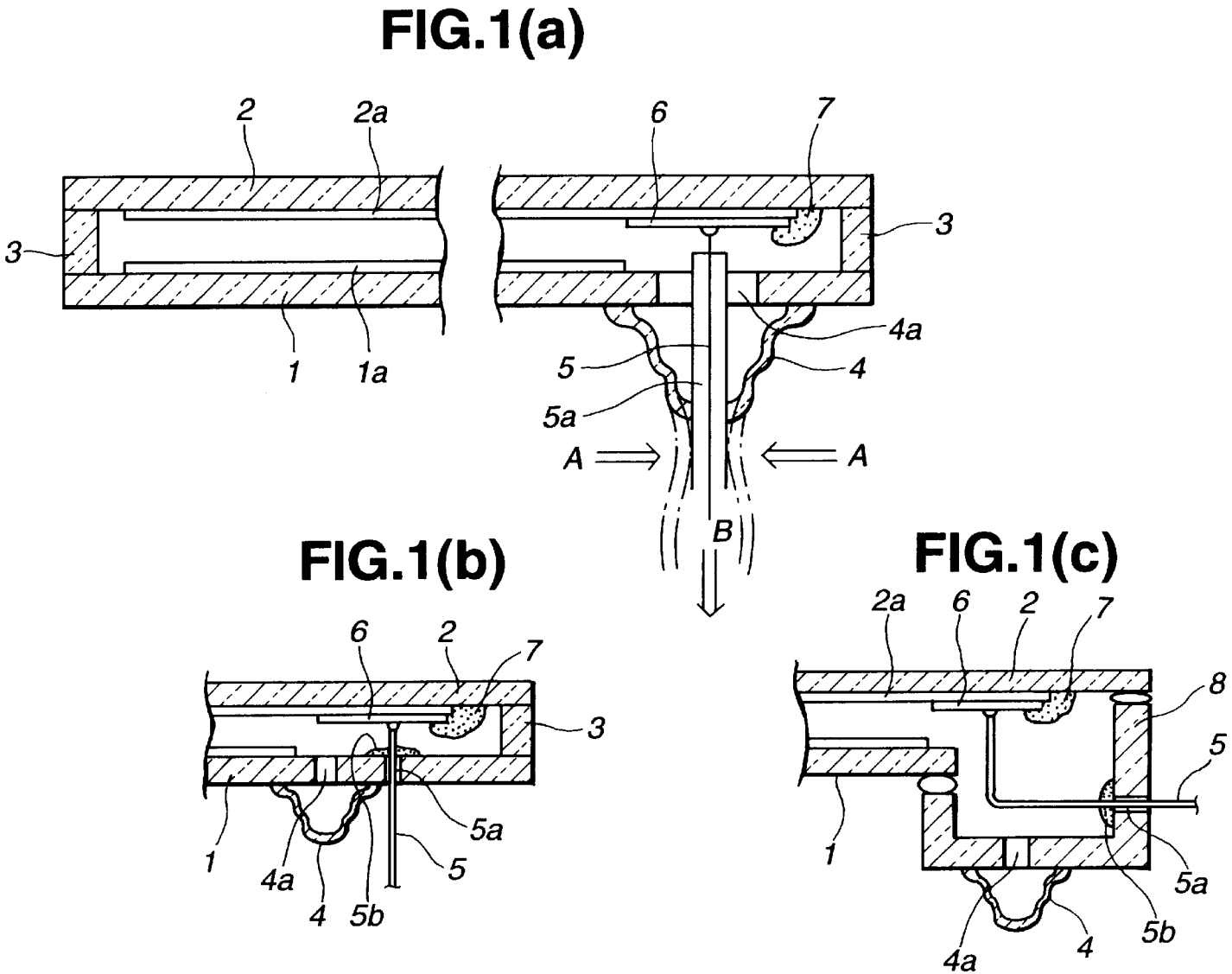
FIGS. 1(*a*), 1(*b*) and 1(*c*) are cross-sectional views each partially illustrating an anode electrode leading structure in a flat vacuum envelope according to the present invention.

The configuration of a vacuum envelope for housing a field emission device according to a first embodiment of the present invention will be described below with reference to FIG. 1(*a*).

Referring to FIG. 1(*a*), numeral 1 represents a first glass substrate on which a field emission region 1*a* formed of emitters and a gate layer are laminated. Numeral 2 represents a second glass substrate on which a fluorescent display substance and an anode 2*a* formed of a transparent electrode are laminated. Numeral 3 represents a side wall portion for defining the vacuum space between the first glass substrate and the second glass substrate. The side wall portion 3 is generally sealed with fritted glass to maintain the inside space in a vacuum state.

Numeral 4 is an exhaust tube attached to the first glass substrate 1 to evacuate the inner space to a vacuum state through the exhaust hole 4*a*. A lead (conductor) 5 is drawn out of the anode through the exhaust tube 4. The lead 5 has one end which is electrically spot-welded to a metal connection electrode plate 6. The metal electrode plate 6 is in contact with the lead electrode for the anode 2*a*.

In this embodiment, the lead 5 is previously covered with a lime glass 5*a* with the substantially same thermal expansion coefficient as that of the exhaust tube 4. The inside of the vacuum envelope is evacuated through the exhaust tube 4 to a vacuum state. Then, the first glass substrate and the second glass substrate are securely bonded while the exhaust tube 4 is being sealed.

The connection electrode plate 6 is preferably is made of SUS (stainless steel) or the 426 alloy and has a diameter of about 5 mm. However, the shape and size of the connection electrode plate depend on those of the vacuum envelope.

Referring to FIG. 1(*a*), the inside of the vacuum envelope is evacuated to a vacuum state. Then, the side surface of the lime glass 5*a* is welded with the inner surface of the exhaust tube 4. In order to configure the anode electrode, the unnecessary portion (shown with chain lines) of the exhaust tube is welded off while it is being pulled in the direction B. The inside of the completed vacuum envelope is maintained in a vacuum state.

In FIG. 1(*a*), the getter used to maintain the vacuum degree is omitted here.

To prevent the separation of the connection electrode plate 6 from the anode 2*a*, the lime glass 7 is welled with the second glass substrate 2 at one end of the connection electrode plate 6. Thus, even when being pulled, the lead 5 is not separated from the connection electrode plate 6.

The lime glass 7 and the connection electrode plate 6 may release gases within the vacuum envelope. Hence, it is preferable to previously suck out residue gases within the vacuum envelope in a sufficient baking process. Then, the inside of the vacuum envelope is evacuated to a vacuum state.

FIG. 1(*a*) shows the example where the lead 5 is externally taken out through the exhaust tube 4. However, as shown in FIG. 1 (*b*), the lead 5, which extends through the hole 5*a* formed at a predetermined position of the first glass substrate 1, may be fixed at the hole 5*a* with the crystallized glass 5*b*. Thus, the lead 5 may be integrally sealed with the glass substrate 1 and be extracted from a position different from the exhaust hole 4*a*.

Moreover, as shown in FIG. 1(C), the end space between the first glass substrate 1 and the second glass substrate 2 may be surrounded with a slightly-thick side wall room 8. The lead 5 may be taken out through the side wall room 8.

Even in this embodiment, the anode 2*a* is laminated with the connection electrode plate 6 to secure the sufficient conductivity. The lead 5 is taken out through the connection electrode plate 6. In this embodiment, a sufficient amount of getter material can be placed in the inner space of the side wall plate 8.

Figure 2:
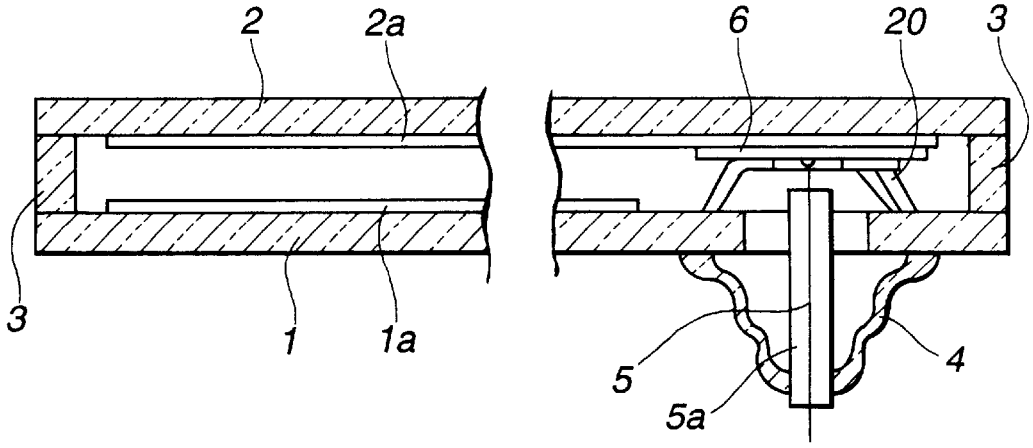
FIG. 2 is a cross-sectional view explaining a flat vacuum envelope with further improved electrode structure according to the present invention.
Figure 3A:
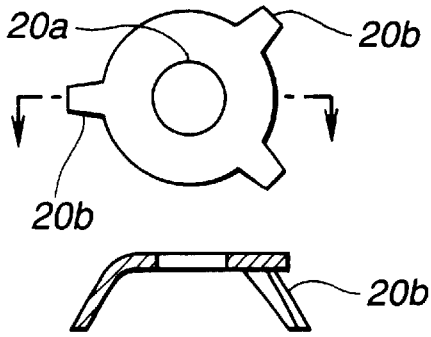
FIGS. 3(*a*), 3(*b*), 3(*c*) and 3(*d*) are diagrams each explaining a spring member used for the electrode structure of a flat vacuum envelope according to the present invention.
Figure 3C:
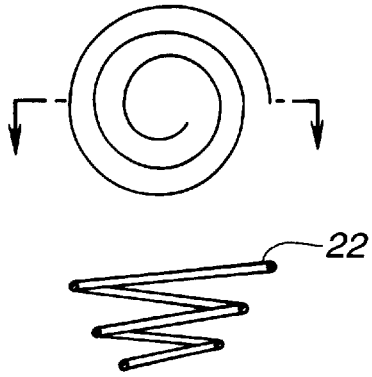
Figure 3B:
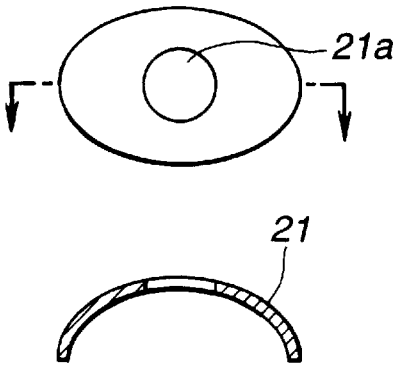
Figure 3D:
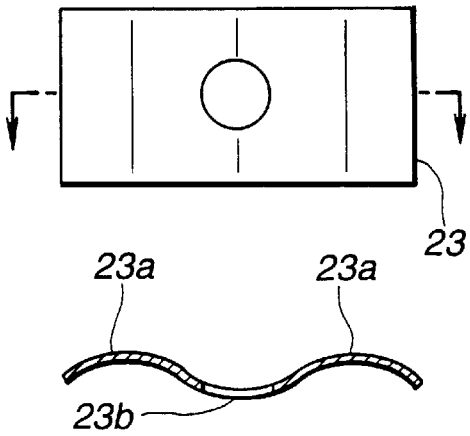

FIG. 2 shows a vacuum envelope according to another embodiment of the present invention. Like numerals represent the same constituent elements as those shown in FIG. 1.

In this embodiment, a spring member 20 is inserted between the connection electrode plate 6 and the first glass substrate 1 to prevent the separation between the connection electrode plate 6 and the anode 2*a*.

The spring member 20 is used to connect the connection electrode plate 6 with the anode 2*a* in a stacked state and can eliminate the lime glass 7 fixing the connection anode plate 6, as shown in FIG. 1. This structure can avoid the risk that self-discharging occurs at the lime glass 7 when a high voltage is applied to the anode. Moreover, this structure provides the advantage of decreasing the number of fabrication steps.

FIG. 3(*a*) shows an example of the spring member 20. The spring member 20 is made of a stainless steel family material which requires the heat-resistant property in the vacuum sealing step and the property of releasing less residue gases within the vacuum space during operation.

That is, the lead 5 covered with the lime glass 5*a* passes through the middle hole 20*a* of the spring member 20. The doughnut-like disk portion of the spring member 20 is in contact with the connection electrode plate 6. The resilient legs 20*b* are pressed against the first glass substrate 1 to connect the connection electrode plate 6 with the anode 2*a*.

The spring member 20 is formed by pressing a thin metal plate such as stainless steel. The thin metal plate is punched to make a disk with a hole 20*a* in the middle thereof and plural legs 20*b* radially-extending from the disk 20*a*. The hole 20*a* is formed to pass the lime glass 5*a*. The plural legs 20*b* are angled at the roots by a bending process.

Next, other aspects of the spring member 20 are listed.

The spring member 21 shown in FIG. 3(*b*) has two legs by simplifying the configuration of FIG. 3(*a*). The spring member 21 is formed by bending an ellipse plate which has the hole 21*a* in the middle thereof. Referring to FIG. 3(*c*), a spring member 22 is formed by spiraling a fine metal wire with the center portion elevated and at intervals larger than the metal line diameter. This spring member 22 can be compressed to the height nearly corresponding to the metal wire diameter. Hence, the spring member 22 is convenient in the case where the spring housing space is small as shown in this example.

The spring member 23 of the thin rectangular plate is crimped as shown in FIG. 3(*d*). Since the convex portions 23*a*, 23*a* crimped are contacted with the connection electrode plate 6 and the convex portions 23*b*, 23*b* are contacted with the first glass plate 1, the contact pressure is effectively alleviated.

In order to prevent the connection point between the lead 5 and the connection electrode plate 6 from being separated during fabrication, the tongue piece 6*a* is cut out at a predetermined position of the connection electrode plate 6 and then is curved in an arc form. The tongue piece 6*a* about which the peripheral area is cut away in a U shape can effectively fixed to the lead 5.

In this case, the one end of the lead 5 is bent at a right angle and is inserted between the surface of the connection electrode plate 6 and the lower surface of the tongue piece 6*a*. Then the tongue piece 6*a* is pushed down against a surface of the connection electrode plate 6 to mechanically fix the lead 5. For tight connection, the lead 5 may be preferably welded or brazed.

Figure 5A:
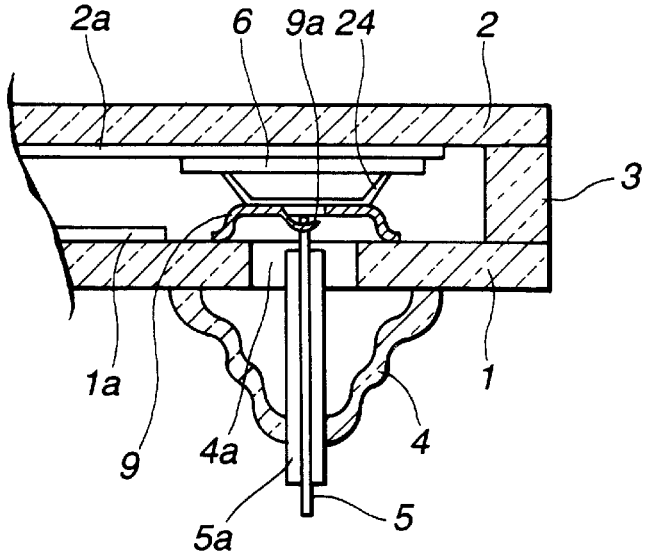
FIG. 5(*a*) is a partial cross-sectional view.
Figure 5B:
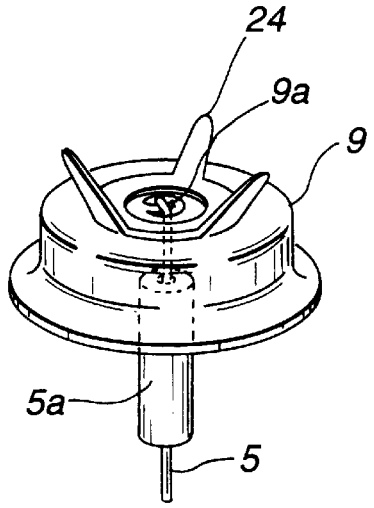

FIG. 5 is a diagram illustrating the configuration of a field emission device containing vacuum envelope according to another embodiment of the present invention. Referring FIG. 5, like numerals represent the same constituent elements as those shown in FIG. 1.

Numeral 1 represents a first glass substrate on which a field emission region 1*a* formed of emitters and a gate layer is laminated. Numeral 2 is a second glass substrate on which an anode 2*a* formed of a fluorescent display substance and a transparent electrode is laminated.

Figure 4A:
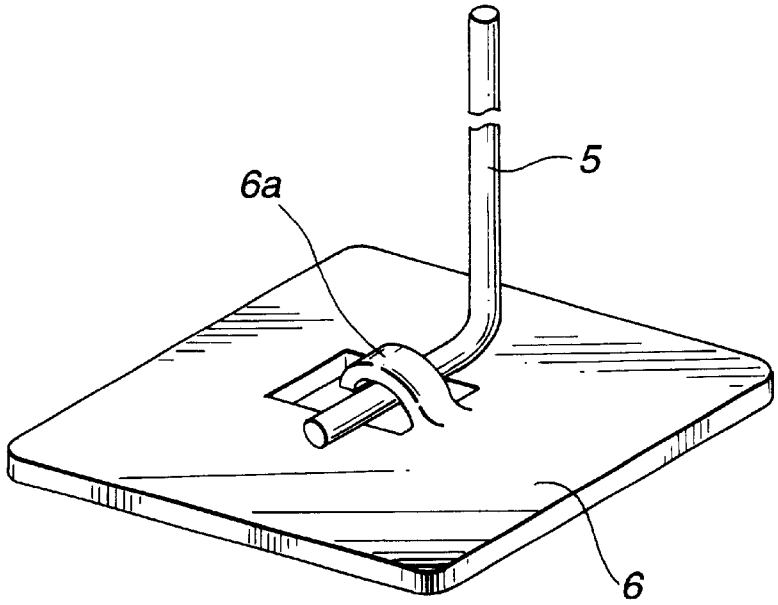
FIG. 4(*a*) is a perspective view.
Figure 4B:
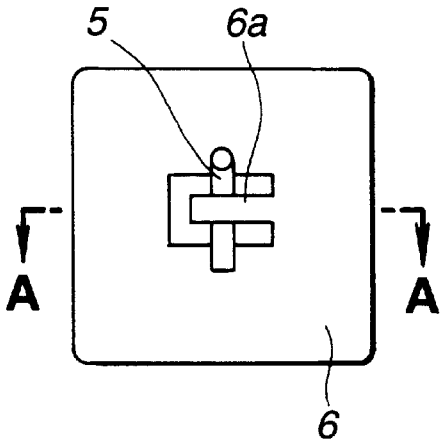
Figure 4C:
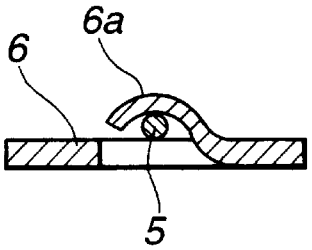

As shown by the perspective view in FIG. 5(*b*), the conductive lead connection plate 9 is placed in the middle of the vacuum envelope. A tongue piece 9*a* with the same shape as the tongue piece 6*a* of FIG. 4 is formed in the middle portion of the lead connection plate 9.

The lead 5 is mechanically fixed to the lead connection plate 9 by means of the tongue piece 9*a* and then is welded or brazed for the purpose of sufficient strengths. The conductive spring member 24 shown in FIG. 3(*a*) is securely fixed to the lead connection plate 9. This structure is inserted between the first glass substrate 1 and the connection electrode plate 6 to press the connection electrode plate 6 against the anode 2*a*.

When the exhaust tube 4 is welded and cut away in a vacuum state while being pulled in the direction B, the tension on the lead 5 is well absorbed by the lead connection plate 9 and the spring member 24. For a while, since the connection electrode plate 6 is pushed against the glass substrate side, there is no risk of peeling the connection electrode plate 6.

Since the first glass substrate 1 can support the tension of the lead, the lead connection plate 9 may be of a disk plate or a rectangular plate.

In the above-mentioned embodiments, the spring member is previously mounted within the vacuum envelope. However, an elliptic exhaust tube 4*a* may be previously prepared. After a vacuum envelope is formed, a thin spring member in a flat state is inserted into the inside of the vacuum envelope from the longitudinal diameter direction of the elliptic exhaust tube. The spring member 20 (as shown in the figure) may be placed on the surface of the connection electrode plate 6.

Figure 6:
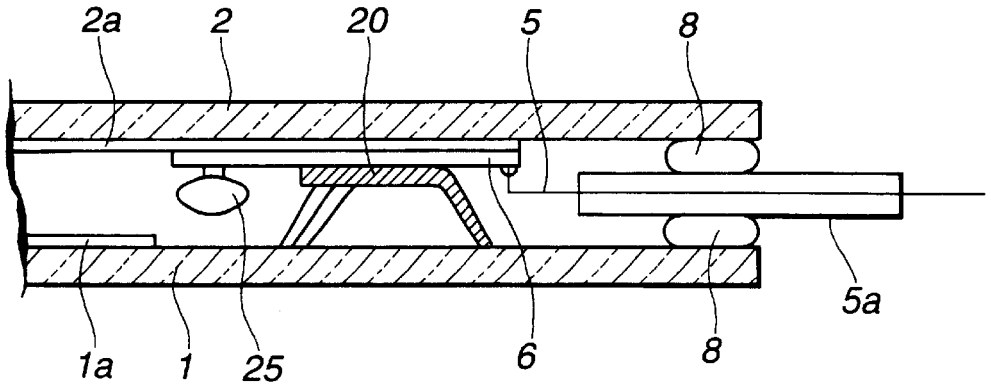
FIG. 6 is a schematic cross-sectional view illustrating the structure where a spring member is used to the connection electrode plate connected to the lead extracted from the side surface.
Figure 7:
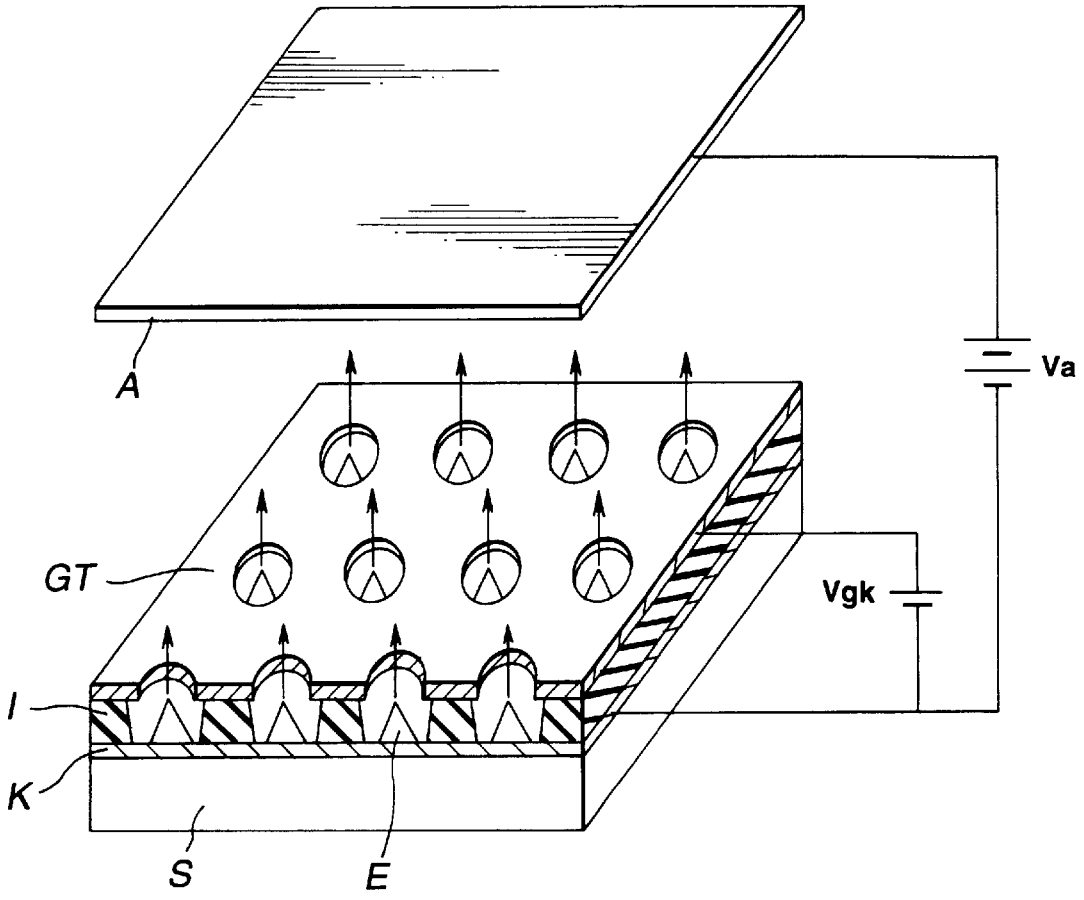
FIG.7 (PRIOR ART)
FIG. 7 is a perspective view illustrating the structure of a Spindt-type field emission cathode.
Figure 8:
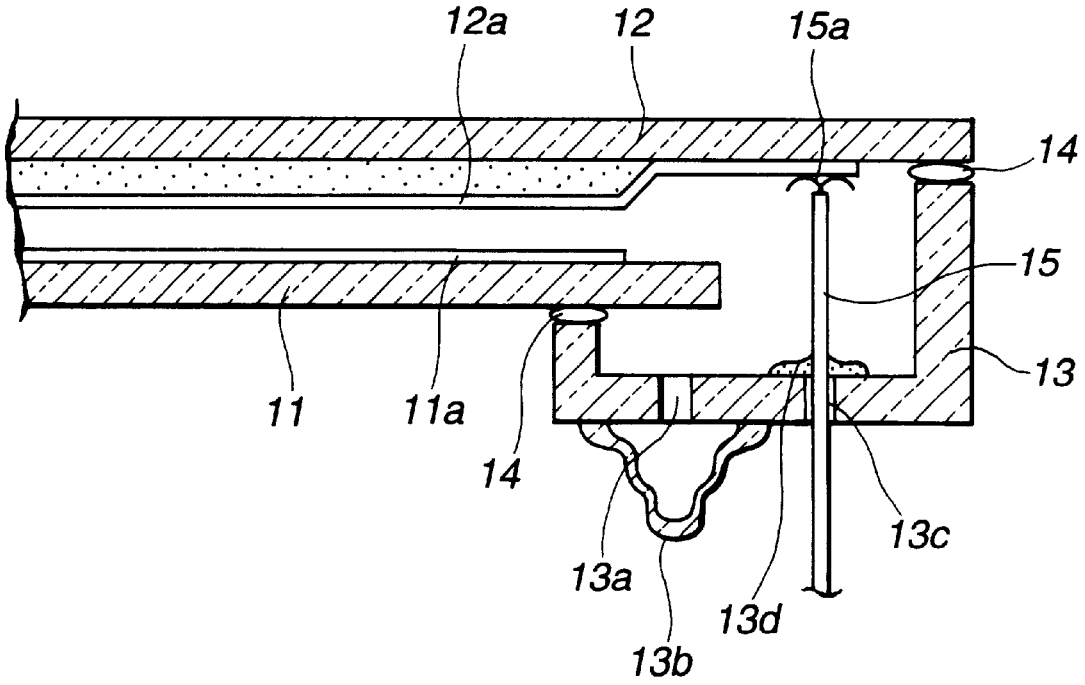
FIG.8 (PRIOR ART)
FIG. 8 is a diagram illustrating the evacuation structure of a vacuum envelope containing a field emission device and the electrode structure in the vacuum envelope.

FIG. 6 shows the field emission device containing vacuum envelope according to further another embodiment of the present invention. Referring to FIG. 6, like numerals represent the same constituent elements as those in FIG. 1.

That is, numeral 1 represents a first glass substrate on which the field emission region 1 formed of emitters and a gate layer is laminated. Numeral 2 represents a second glass substrate on which a fluorescent display substance and an anode 2*a* formed of a transparent electrode are laminated. Numeral 25 represents a getter fixed on the connection electrode plate 6.

The anode lead 5 covered with the lime glass 5*a* is externally extracted out of the space (side surface) between the first glass substrate 1 and the second glass substrate 2.

The sealing glass 8 hermetically seals the spaces of the side wall portion of the vacuum envelope defined by the lime glass 5*a* supporting the lead 5, the first glass substrate 1 and the second glass substrate 2 to maintain a vacuum state.

A part of the lead 5 is electrically connected to the connection electrode plate 6 in contact with the anode 2*a*. The spring member 20 presses the connection electrode plate 6 against the anode 2*a*.

In this case, the vacuum envelope is evacuated to a vacuum state using the exhaust hole and the exhaust tube (not shown). When the lead 5 is previously sealed at the sides of the vacuum envelope with the sealing glass 8, the spring member 20 electrically connects the anode 2*a* with the connection electrode plate 6, thus resulting in stable electrical connection.

Even in the first and second embodiments, other member, e.g. the getter 25, contained in the vacuum envelope may be previously and integrally fixed to the connection electrode plate 6, so that the workability in assembly is improved. The spring member 20 may be previously fixed to the connection electrode plate 6.

The electrode configuration of the present invention has been described regarding vacuum envelopes for photoelectric conversion elements or displays employing the field emission devices being area-emission-type cold cathode ray tubes. However, the present invention is widely applicable to vacuum envelopes requiring the evacuating and sealing step.

As described above, the electrode configuration of the flat vacuum envelope according to the present invention is employed for a flat vacuum envelope including field emission elements. Consequently, a high voltage can be effectively applied to the electrode connection with high reliability, without the occurrence of self-discharging.

Moreover, the breakage between the lead and the connection electrode plate or the separation between the connection electrode plate and the anode can be prevented in the evacuating and sealing step. This contributes to improved yields in fabrication.

The reliable electrical connection between the connection electrode plate and the anode can be ensured, thus expectantly decreasing the failure occurrence after product shipment.

The getter previously attached to the connection electrode plate can reduce the number of assembly steps.

What is claimed is:

1. An electrode structure within a flat vacuum envelope comprising:

a first glass substrate on which field emission cathodes are arranged on a surface thereof;

a second glass substrate on which an anode electrode to attract electrons emitted from said field emission cathodes, said second glass substrate being confronted with said first glass substrate, a space between said first glass substrate and said second glass substrate being maintained in a vacuum state;

a conductive metal plate being securely fixed to said anode electrode and acting as a connection electrode plate; and a lead connected to said connection electrode plate and externally extended through a wall surface of said vacuum envelope, wherein said connection electrode plate is pushed against said anode electrode with a resilient member securely fixed to said first glass substrate.

2. The electrode structure defined in claim 1, further comprising another resilient member inserted between said resilient member and said first glass substrate.

3. An electrode structure within a flat vacuum envelope comprising:

a first glass substrate on which field emission cathodes are arranged on a surface thereof;

a second glass substrate on which an anode electrode to attract electrons emitted from said field emission cathodes, said second glass substrate being confronted with said first glass substrate, a space between said first glass substrate and said second glass substrate being maintained in a vacuum state;

a conductive metal plate being securely fixed to said anode electrode and acting as a connection electrode plate; and a lead connected to said connection electrode plate and externally extended through a wall surface of said vacuum envelope, wherein said lead is externally extended through an exhaust hole opened at a predetermined position of said first glass substrate and an exhaust tube sealing said exhaust hole.

4. The electrode structure defined in claim 1, 3 or 2, wherein said lead has one bent end securely attached with a cut piece of said connection metal plate.

5. The electrode structure defined in claim 3, wherein said lead extending though said exhaust tube is covered with a glass with the same thermal expansion coefficient as that of the first glass substrate.

6. An electrode structure within a flat vacuum envelope comprising:

a first glass substrate on which field emission cathodes are arranged on a surface thereof;

a second glass substrate one which an anode electrode to attract electrons emitted from said field emission cathodes, said second glass substrate being confronted with said first glass substrate;

a lead penetrating a space between a side surface of said first glass substrate and a side surface of said second glass substrate confronting from each other, said space being sealed with a sealing glass; and a connection electrode plate securely joined with one end of said lead within said vacuum envelope and being in electrical contact with said electrode;

whereby said connection electrode plate is pushed against said second glass substrate with a resilient member, wherein said lead is sealed with a glass with the substantially the same thermal expansion coefficient as that of said sealing glass.

7. The electrode substrate defined in claim 6, further comprising a getter placed within said vacuum envelope and securely attached on said connection electrode plate.

* * * * *